US005245799A

United States Patent [19]

Sugiyama

[11] Patent Number: 5,245,799

[45] Date of Patent: Sep. 21, 1993

[54] APPARATUS FOR OPENING AND CLOSING COVERING MEANS FOR FURNITURE RAISING/LOWERING TYPE FLOOR EQUIPMENT

[75] Inventor: Noboru Sugiyama, Tokyo, Japan

[73] Assignee: Kabushiki Kaisha Kotobuki, Tokyo, Japan

[21] Appl. No.: 799,420

[22] Filed: Nov. 27, 1991

[30] Foreign Application Priority Data

Dec. 27, 1990 [JP] Japan ..... 2-406909[U]

[51] Int. Cl.[5] ..... E04H 3/12

[52] U.S. Cl. ..... 52/10; 297/331; 297/378

[58] Field of Search ..... 52/6, 7, 8, 9, 10; 472/59; 297/330-334, 378, 379

[56] References Cited

U.S. PATENT DOCUMENTS

| | | | |
|---|---|---|---|
| 4,211,450 | 7/1980 | Sutter | 52/9 X |
| 4,294,048 | 10/1981 | Sutter | 52/9 |
| 4,569,162 | 2/1986 | Suzuki | 52/9 |
| 4,850,159 | 7/1989 | Conner | 52/9 |
| 4,854,092 | 8/1989 | Chatenay | 52/10 |
| 4,879,849 | 11/1989 | Hollingsworth, III et al. | 52/10 |

FOREIGN PATENT DOCUMENTS

| | | |
|---|---|---|
| 2319065 | 7/1975 | France . |
| 2569094 | 8/1984 | France . |

*Primary Examiner*—Richard E. Chilcot, Jr.
*Attorney, Agent, or Firm*—Oldham, Oldham & Wilson Co.

[57] ABSTRACT

An apparatus for opening and closing covering means for a furniture raising/lowering type floor equipment employable for a building such as a hall, a theater, a gymnasium or the like wherein the covering means in the form of a rigid cover plate is accommodated in a cover plate accommodating gap with the aid of a link mechanism when a plurality of furniture accommodated in a furniture accommodating chamber in an inoperative state are to be raised up to stand upright above the floor surface of the building thereby to assume an operative state is disclosed. The link mechanism comprises an opposing pair of links each having cutouts formed at the opposite ends thereof and an opposing pair of slide links pivotally connected to one end of the cover plate. A flexible cover plate adapted to be laid across the furniture accommodating chamber may be substituted for the solid cover plate. The flexible cover plate includes an opposing pair of chains with a flexible cover portion comprising a plurality of plate pieces bridged therebetween at the central part thereof while hollow spaces are formed before and behind the flexible cover portion. Alternatively, the flexible cover plate may includes a single hollow space in one half region thereof.

2 Claims, 11 Drawing Sheets

APPARATUS FOR OPENING AND CLOSING COVERING MEANS FOR FURNITURE RAISING/LOWERING TYPE FLOOR EQUIPMENT

BACKGROUND OF THE INVENTION

1. Field of the Invention

The present invention relates to an apparatus for opening and closing covering means for a furniture raising/ lowering type floor equipment employable for a building such as a hall, a theater, a gymnasium or the like. More particularly, the present invention relates to an improvement of the apparatus for opening and closing covering means for a furniture raising/lowering type floor equipment wherein the covering means in the form of a rigid cover plate, a flexible cover plate or the like can smoothly be opened and closed so as to allow furnitures such as chairs, tables or the like to be raised up above the floor surface of a building such as a hall, a theater, a gymnasium or the like to assume an operative attitude and lowered below the floor surface of the same to assume an inoperative attitude.

2. Description of the Related Art

In recent years, a building such as a hall, a theater, a gymnasium or the like has been increasingly utilized in a multi-purposed fashion. To this end, research and development works have been conducted for providing various kinds of furniture floor equipments. As is well known, this kind of furniture floor equipments are generally classified into two types, i.e., an expansible/contractible platform displacing type floor equipment and a furniture raising/ lowering type floor equipment. An item of the present invention belongs to the latter type of floor equipment, i.e, a furniture raising/lowering type floor equipment.

For the purpose of simplification, description will be made below with respect to a most popular chair raising/ lowering type floor equipment. The conventional chair raising/lowering type floor equipment is usually constructed such that a plurality of chairs (an array of chairs jointed to each other in the side-by-side relationship as seen in the transverse direction) are mounted on a raising/lowering unit for a building such as a hall, a theater, a gymnasium or the like so as to enable each audience to enjoy a performance while sitting on a chair allocated to him. When the chairs are to be in use, an operator turnably opens a cover in the form of a flat plate for the chair floor equipment by driving a driving unit so that the chairs are raised up above the floor surface of the building through the opening portion of a chair accommodating chamber to stand upright thereon and they are then slightly inclined in the rearward direction. At this time, the cover is held in the upright standing state behind an array of chairs. At this time, the cover is merely an obstacle. Thus, an appearance of the chair floor equipment is degraded unavoidably. This is not acceptable also for the building from the viewpoint of an aesthetical property of the building.

When the performance is over, the chairs are lowered in the chair accommodating chamber below the floor surface of the building while they are flatly folded. Subsequently, the operator turnably closes the cover to shut the opening portion of the chair accommodating chamber with the cover so that the cover is flush with the floor surface of the building and becomes a part of the floor surface of the same without any unnecessary projection thereabove.

Since the cover for the chair raising/lowering type floor equipment is constructed in the above-described manner, when the chairs are to be in use, the cover which has been laid over the opening portion of the chair accommodating chamber below the floor surface of the building is turnably opened to stand upright behind an array of chairs as a kind of visually unacceptable obstacle. This leads to the result that a considerably large space is unavoidably occupied by the cover on the floor surface of the building, resulting in an aesthetic property of the chair raising/lowering type floor equipment as well as the building being degraded undesirably.

SUMMARY OF THE INVENTION

The present invention has been made with the foregoing background in mind.

An object resides of the present invention is to provide an apparatus for opening and closing covering means for a furniture raising/lowering type floor equipment employable for a building such as a hall, a theater, a gymnasium or the like wherein the apparatus assures that the covering means can smoothly be opened and closed without any unnecessary projection above the floor surface of the building when a plurality of furnitures such as chairs, tables or the like are raised up above the floor surface of the building to assume an operative attitude as well as when they are accommodated in a furniture accommodating chamber below the floor surface of the building to assume an inoperative attitude.

Another object of the present invention is to provide an apparatus for opening and closing covering means for a furniture raising/lowering type floor equipment employable for a building such as a hall, a theater, a gymnasium or the like wherein when a plurality of furniture such as chairs, table or the like are accommodated in a furniture accommodating chamber to assume an inoperative attitude, the covering means becomes a part of the floor surface of the building without any deterioration of an aesthetical property of the furniture floor equipment as well as the building.

According to one aspect of the present invention, there is provided an apparatus for opening and closing covering means for a furniture raising/lowering type floor equipment employable for a building such as a hall, a theater, a gymnasium or the like wherein the covering means is prepared in the form of rigid cover plate, wherein the apparatus comprises a furniture accommodating chamber in which a plurality of furnitures are accommodated in a folded state to assume an inoperative attitude when they are not in use; a raising/ lowering unit vertically displaceably arranged in the furniture accommodating chamber with the furniture mounted thereon, the raising/lowering unit being raised up by activating a driving unit so as to allow the furnitures to be unfolded and then stand upright above the floor surface of the building to assume an operative attitude; a cover plate accommodating gap formed adjacent to the furniture accommodating chamber with frames and guide rails located therebetween; an opposing pair of links each having cutouts formed at the opposite ends thereof such that each of the links turns about a first shaft projecting from the frame while a second shaft projecting from the raising/ lowering unit is received in the inner cutout of the link and a third shaft projecting from a slide link is received in the outer cutout of the same; and an opposing pair of slide links pivotally connected to one end of the cover plate and slidably arranged in the cover plate accommodating gap; whereby as the raising/lowering unit is raised up, the links turn about the first shafts with the aid of the second shafts in the inner cutouts of the links to slidably displace the slide links in the downward direction via the third shafts in the outer cutouts of the same thereby to turnably pull down the cover plate in the cover plate accommodating gap until the cover plate is fully accommodated in the cover plate accommodating gap.

To facilitate slidable displacement of the cover plate, it is recommendable that rollers are arranged on each guide rail, and one of the rollers is located at the upper end of the guide rail.

In addition, according to other aspect of the present invention, there is provided an apparatus for opening and closing covering means for a furniture raising/lowering type floor equipment employable for a building such as a hall, a theater, a gymnasium or the like wherein the covering means is prepared in the form of a flexible cover plate, wherein the apparatus comprises a furniture accommodating chamber comprising a first furniture accommodating sub-chamber in which a plurality of first kind of furnitures are accommodated in a folded state to assume an inoperative state and a second furniture accommodating sub-chamber in which a plurality of second kind of furnitures are accommodated in a folded state to assume an inoperative attitude; raising/lowering units vertically displaceably arranged in the first and second furniture accommodating sub-chambers with the first and second kinds of furnitures mounted thereon, the raising/lowering unit in the first furniture accommodating sub-chamber being raised up independently of the raising/ lowering unit in the second furniture accommodating sub-chamber by activating a driving unit so as to allow the first kind of furnitures to be unfolded and then stand upright above the floor surface of the building to assume an operative attitude while the raising/lowering unit in the second furniture accommodating sub-chamber is held immovable, and vice versa; cover plate accommodating gaps formed on the opposite sides of the furniture accommodating chamber with frames located therebetween; and the flexible cover plate including an opposing pair of chains with a flexible cover portion comprising a plurality of plate pieces bridged therebetween at the central part thereof while hollow spaces are formed before and behind the flexible cover portion, a length of the flexible cover portion as seen in the direction of slidable displacement being dimensioned to coincide with a width of each of the first and second furniture accommodating sub-chamber and a length of each of the chains being dimensioned to be much longer than a width of the furniture accommodating chamber; whereby as the raising/ lowering unit in the first furniture accommodating sub-chamber is raised up independently of the raising/ lowering unit in the second furniture accommodating sub-chamber, the flexible cover plate is slidably displaced in one direction by a driving unit operatively associated with the driving unit for the raising/ lowering unit so as to allow only the first kind of furnitures are raised up through one of the hollow spaces of the flexible cover plate to be unfolded and then stand upright above the floor surface of the building to assume an operative attitude while the chains of the flexible cover plate are accommodated in one of the cover plate accommodating gaps, and vice versa.

The first kind of furnitures in the first furniture accommodating sub-chamber may be same to the second kind of furnitures in the second furniture accommodating sub-chamber.

Alternatively, the first kind of furnitures in the first furniture accommodating sub-chamber may be different from the second kind of furnitures in the second furniture accommodating sub-chamber.

Additionally, according to another aspect of the present invention, there is provided an apparatus for opening and closing covering means for a furniture raising/lowering type floor equipment employable for a building a hall, a theater, a gymnasium or the like wherein the covering means is prepared in the form of a flexible cover plate, wherein the apparatus comprises a furniture accommodating chamber in which a plurality of furnitures are accommodated in a folded state to assume an inoperative state when they are not in use; a raising/lowering unit vertically displaceably arranged in the furniture accommodating chamber with the furnitures mounted thereon, the raising/lowering unit being raised up by activating a driving unit so as to allow the furnitures to be unfolded and then stand upright above the floor surface of the building to assume an operative attitude; cover plate accommodating gaps formed on the opposite sides of the furniture accommodating chamber with sprockets disposed at the upper ends of frames which define the cover plate accommodating gaps; and the flexible cover plate including an opposing pair of chains with a flexible cover portion comprising a plurality of plate pieces bridged therebetween in one half region thereof while a hollow space is formed in other half region of the flexible cover plate, a length of the flexible cover portion as seen in the direction of slidable displacement being dimensioned to coincide with a width of the furniture accommodating chamber and a length of each of the chains being dimensioned to be substantially twice as long as the width of the furniture accommodating chamber; whereby as the raising/lowering unit is raised up, the flexible cover plate is slidably displaced in one direction by a driving unit operatively associated with the driving unit for the raising/lowering unit with the aid of the sprockets so as to allow the furnitures to be raised up through the hollow space of the flexible cover plate to be unfolded and then stand upright above the floor surface of the building to assume an operative state while the flexible cover portion is accommodated in one of the cover plate accommodating gaps via one of the sprockets.

The opposite ends of the flexible cover plate are fixedly secured to the upper ends of the frames which define the cover plate accommodating gaps.

Other objects, features and advantages of the present invention become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Figure 2:
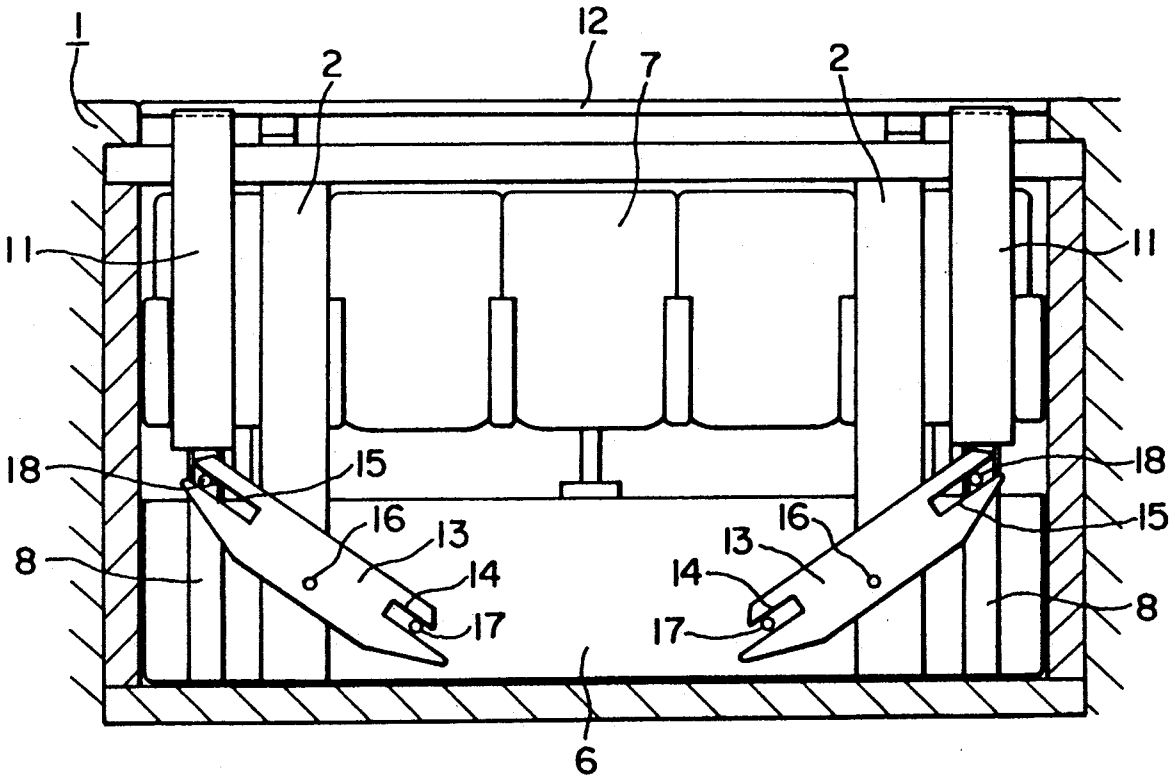
FIG. 2 is a vertical sectional front view of the apparatus shown in FIG. 1.

Now, the present invention will be described in detail hereinafter with reference to the accompanying drawings which illustrate preferred embodiments of the present invention.

FIG. 1 to FIG. 8 illustrate an apparatus for opening and closing a rigid cover plate for a chair raising/lowering type floor equipment employable for a building such as a hall, a theater, a gymnasium or the like in accordance with a first embodiment of the present invention.

Throughout the drawings, reference numeral 1 designates a floor platform of the building. A chair accommodating chamber 4 and a cover plate accommodating gap 5 are arranged in the floor platform 1 while frames 2 stand upright in the floor platform 1.

Reference numeral 6 designates a raising/lowering unit which is arranged to move up and down in the chair accommodating chamber 4 as a driving unit (not shown) is actuated. As is best seen in FIG. 2, a plurality of foldable chairs 7 are immovably mounted on the upper surface of the raising/lowering unit 6 such that the chairs 7 are raised up above the floor surface of the building or lowered in the chair accommodating chamber 4.

Reference numeral 8 designates guide rails. As shown in FIG. 2, the guide rails 8 stand upright outside of the frames 2 in the spaced relationship on the left-hand and right-hand sides relative to the cover plate accommodating gap 5. Rollers 9 are rotatably mounted on the uppermost ends of the guide rails 8, and slide links 11 come in slidable contact with the guide rails 8 via rollers 10.

Reference numeral 12 designates a rigid cover plate for closing an opening portion 3 of the chair accommodating chamber 4 therewith. One end of the cover cover 12 is turnably secured to the upper end of each slide link 11.

Reference numeral 13 designates an opening/closing link. Cutout grooves 14 and 15 are formed on the opposite ends of the opening/closing link 13. The opening/closing link 3 is turnably supported in the space defined between the both frames 2 to turn about a shaft 16 disposed at the central part thereof. A shaft 17 projecting from the raising/lowering unit 6 is operatively engaged with each inside cutout groove 14, while a shaft 18 projecting from each guide rail 8 is operatively engaged with each outside cutout groove 5. As shown in FIG. 2, the lower end of each slide link 11 comes in contact the outermost end of each opening/closing link 13.

Figure 1:
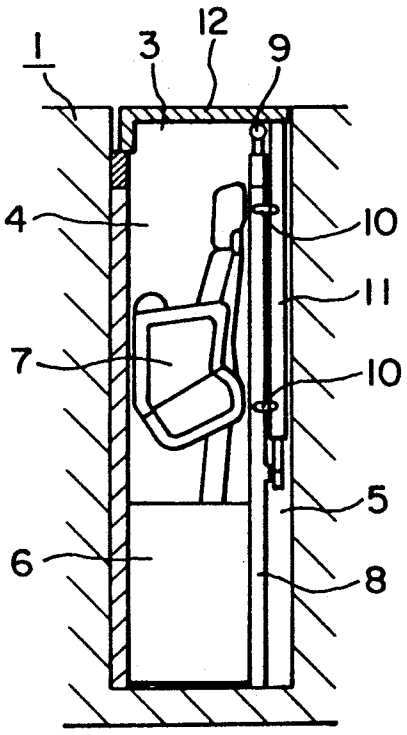
FIG. 1 is a vertical sectional side view of an apparatus for opening and closing a rigid cover plate for a chair raising/lowering type floor apparatus employable for a building such as a hall, a theater, a gymnasium or the like in accordance with a first embodiment of the present invention, particularly illustrating that a plurality of chairs are accommodated in a chair accommodating chamber.

As shown in FIG. 1 and FIG. 2, with such construction as described above, as long as the chairs 7 are accommodated in the chair accommodating chamber 4 in the folded state, the opening portion 13 of the chair accommodating chamber 4 is closed with the cover plate 12 so that a flat surface flush with the floor surface of the building is formed across the opening portion 3 of the chair accommodating chamber 4.

Figure 4:
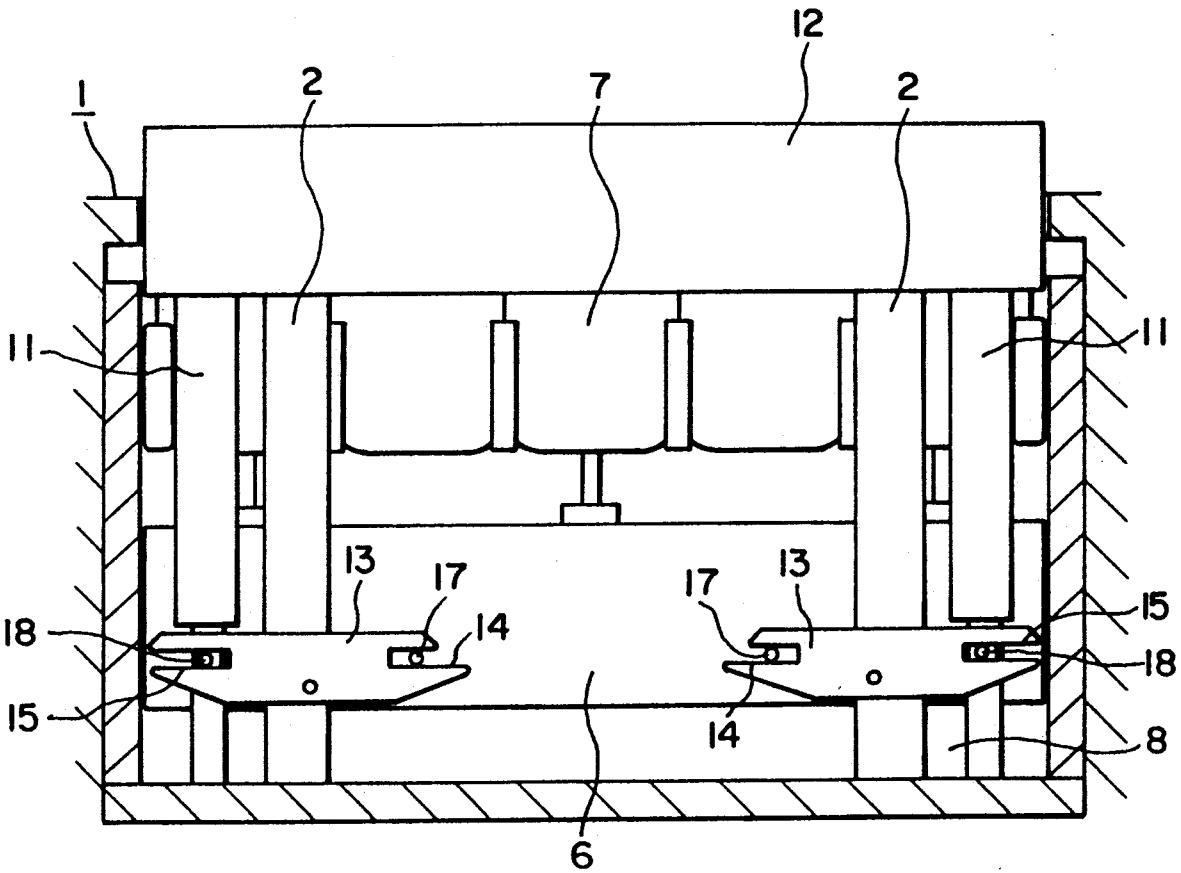
FIG. 4 is a vertical sectional front view of the apparatus shown in FIG. 3.
Figure 3:
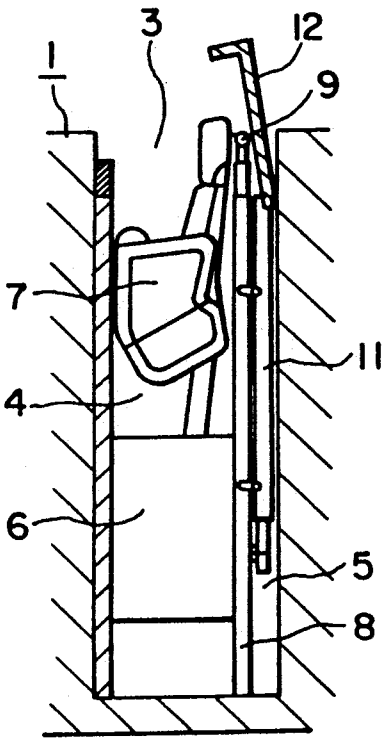
FIG. 3 is a vertical sectional side view of the apparatus, particularly illustrating that the cover plate is half accommodated in a cover plate accommodating gap.

When the respective chairs 7 are to be shifted to an operative attitude from the foregoing inoperative attitude, the raising/lowering unit 6 is actuated by the driving unit in the upward direction so that the chairs 7 are raised up above the floor surface of the building. As the raising/ lowering unit 6 is raised up, the shafts 17 projecting therefrom are correspondingly raised up, causing each opening/closing link 13 to turn about the shaft 16 while each outside cutout groove 15 is turnably displaced in the downward direction. At the same time, the slide links 11 are displaced in the downward direction via the shafts 18 so that the cover plate 12 pivotally connected to the slide links 11 is downwardly turned about the rollers 9 each serving as fulcrum so as to allow the chair accommodating chamber 4 to be increasingly exposed to the outside. As turnable downward displacement of the cover plate 12 continues, the cover plate 12 is accommodated in the cover plate accommodating gap 5, as shown in FIG. 3 and FIG. 4.

Figure 6:
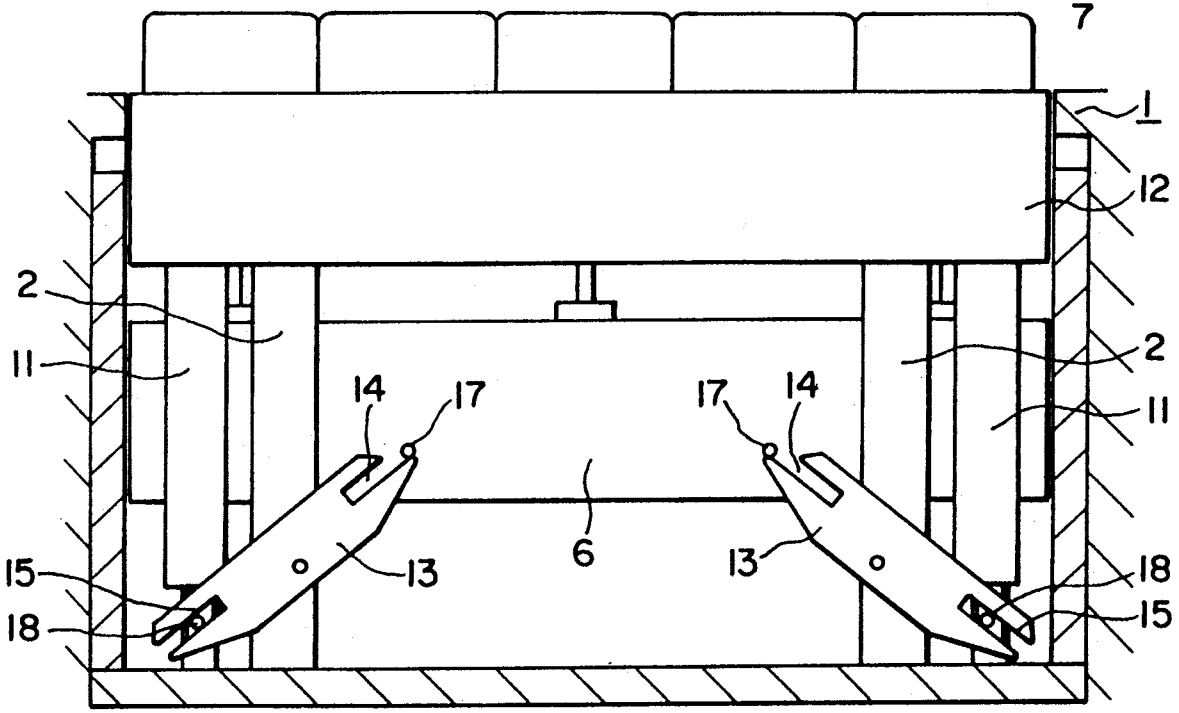
FIG. 6 is a vertical sectional front view of the apparatus shown in FIG. 5.
Figure 5:
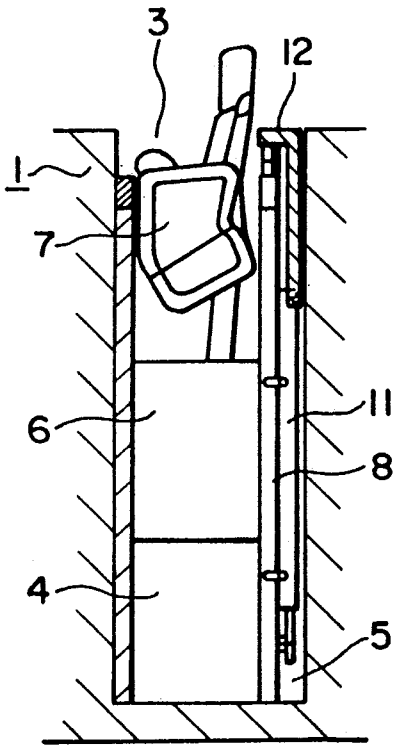
FIG. 5 is a vertical sectional side view of the apparatus, particularly illustrating that the cover plate is fully accommodating gap.
Figure 8:
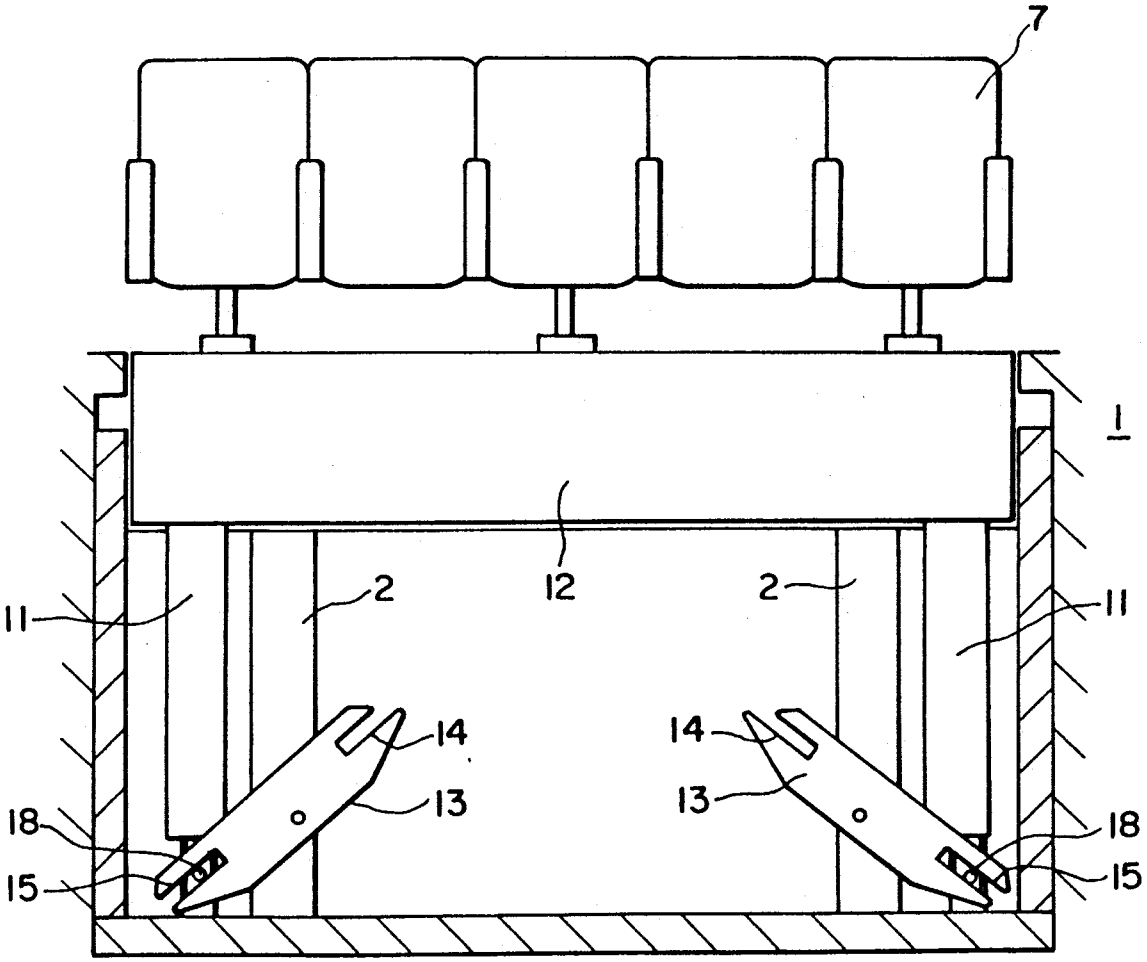
FIG. 8 is a vertical sectional front view of the apparatus shown in FIG. 7.

When the raising/lowering unit 6 is raised up further, the shafts 17 projecting from the raising/lowering unit 6 are disengaged from the inside cutout grooves 14. At this time, the cover plate 12 is downwardly drawn in the cover plate accommodating gap 5 with the aid of the opening/closing links 13 and the slide links 11 until it is fully accommodated in the cover plate accommodating gap 5, as shown in FIG. 5 and FIG. 6. Thus, there is no possibility that the opening portion 3 of the chair accommodating chamber 4 is closed with the cover plate 12 by its own dead weight.

Figure 7:
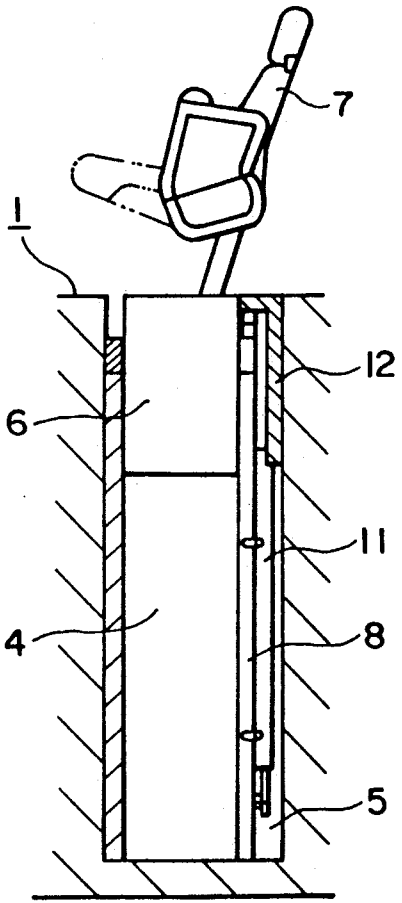
FIG. 7 is a vertical sectional side view of the apparatus, particularly illustrating that the chairs mounted on a raising/lowering unit are raised up above the floor surface of the building to assume an operative attitude.

When the raising/lowering unit 6 is raised up until it reaches the opening portion 13 of the chair accommodating chamber 4 which coincides with the floor surface of the building, the chairs 7 are upwardly thrusted at the location corresponding to the floor surface of the building. Thereafter, a chair tilting mechanism (not shown) in the raising/ lowering unit 6 is actuated so that the respective chairs 7 are brought in their operative state, as shown in FIG. 7.

On the contrary, when the chairs 7 are to be accommodated in the chair accommodating chamber 4 to assume an inoperative attitude, a series of operations are performed in conformity with the reverse order to the aforementioned one. Specifically, as the raising/lowering unit 6 is lowered, the chairs 7 are increasingly accommodated in the chair accommodating chamber 4 and the shafts 17 projecting from the raising/lowering unit 6 are brought in engagement with the inside cutout grooves 14 to turn the opening/ closing links 11 in the opposite direction to the aforementioned one, whereby the slide links 11 are raised up via the shafts 18. Subsequently, the opening portion 3 of the chair accommodating chamber 4 is closed with the cover plate pivotally connected to the slide links 11.

Next, description will be made below with reference to FIG. 9 to FIG. 12 with respect to an apparatus for opening and closing covering means for a furniture raising/lowering equipment employable for a building such as a hall, a theater, a gymnasium or the like in accordance with a second embodiment of the present invention wherein the covering means is prepared in the form of a flexible cover plate in contrast with the rigid cover plate in the first embodiment of the present invention.

In the drawings, reference numeral 101 designates a floor platform of the building. The apparatus includes a first furniture accommodating section 102 and a second furniture accommodating section 103 both of which are arranged in the floor platform 101 in the side-by-side relationship.

The first furniture accommodating section 102 includes a fore accommodating chamber 106 and a rear accommodating chamber 107 with a frame 104 interposed therebetween, and the upper end of each of the accommodating chambers 106 and 107 is exposed to the outside while forming an opening portion 105. In addition, a cover plate accommodating gap 108 is formed behind the frame 104 of the fore accommodating chamber 106, while another cover accommodating gap 109 is formed behind the frame 104 of the rear accommodating chamber 107. As is apparent from the drawings, both the cover accommodating gaps 108 and 109 are arranged in the side-by-side relationship without any partition therebetween. A raising/lowering unit 110 adapted to be raised up and lowered by activating a driving unit (not shown) is received in each of the accommodating chambers 106 and 107. A flexible cover plate 110 adapted to be displaced in the forward/rearward direction by a driving unit (not shown) is laid across the upper surfaces of the accommodating chambers 106 and 107 while a part of the flexible cover plate 110 is accommodated in the cover plate accommodating gaps 108 and 109.

Figure 10:
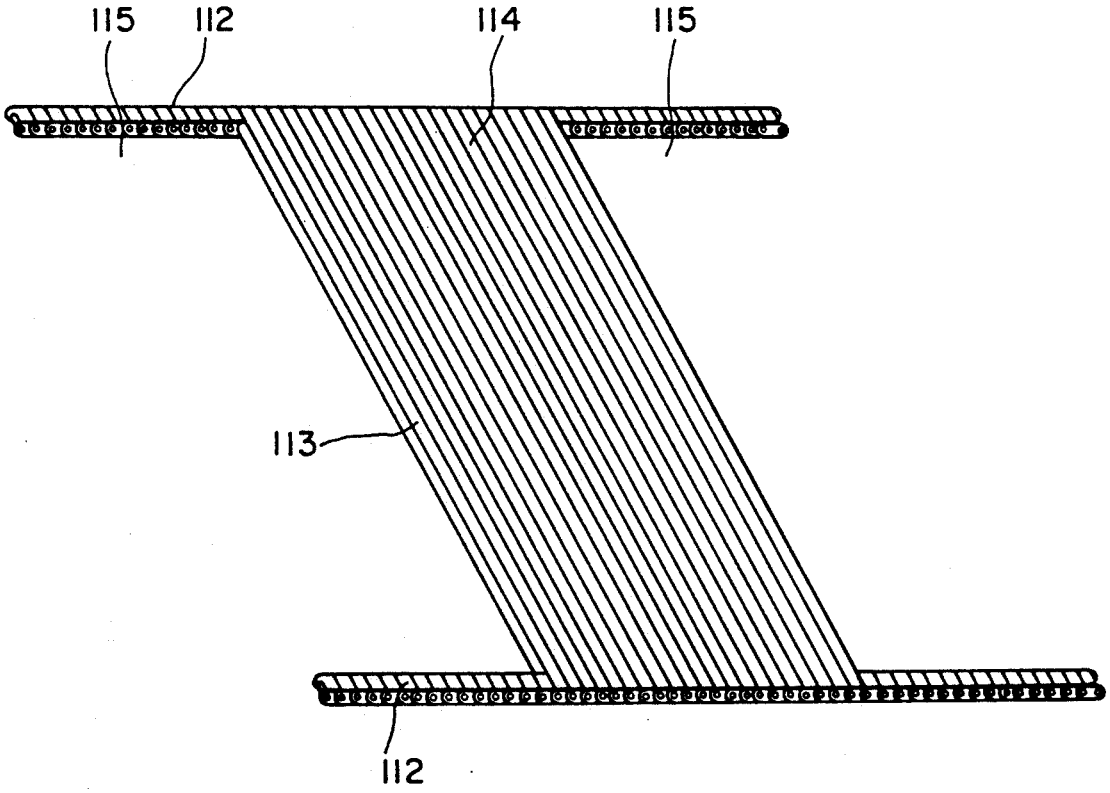
FIG. 10 is a perspective view of the flexible cover plate.
Figure 11:
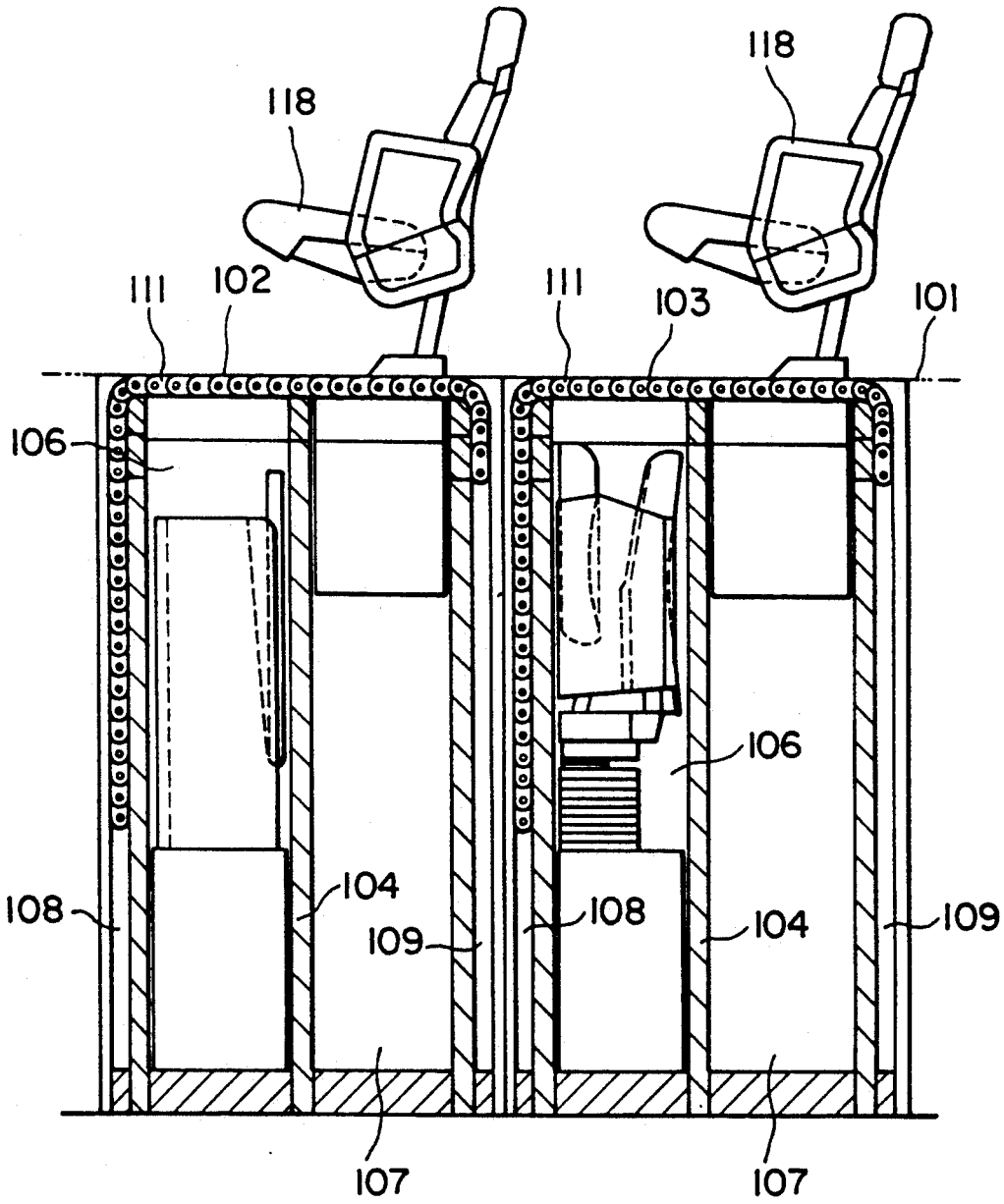
FIG. 11 is a vertical sectional side view of the apparatus, particularly illustrating that only the chairs mounted on raising/lowering units are raised up above the floor surface of the building to assume an operative attitude.
Figure 12:
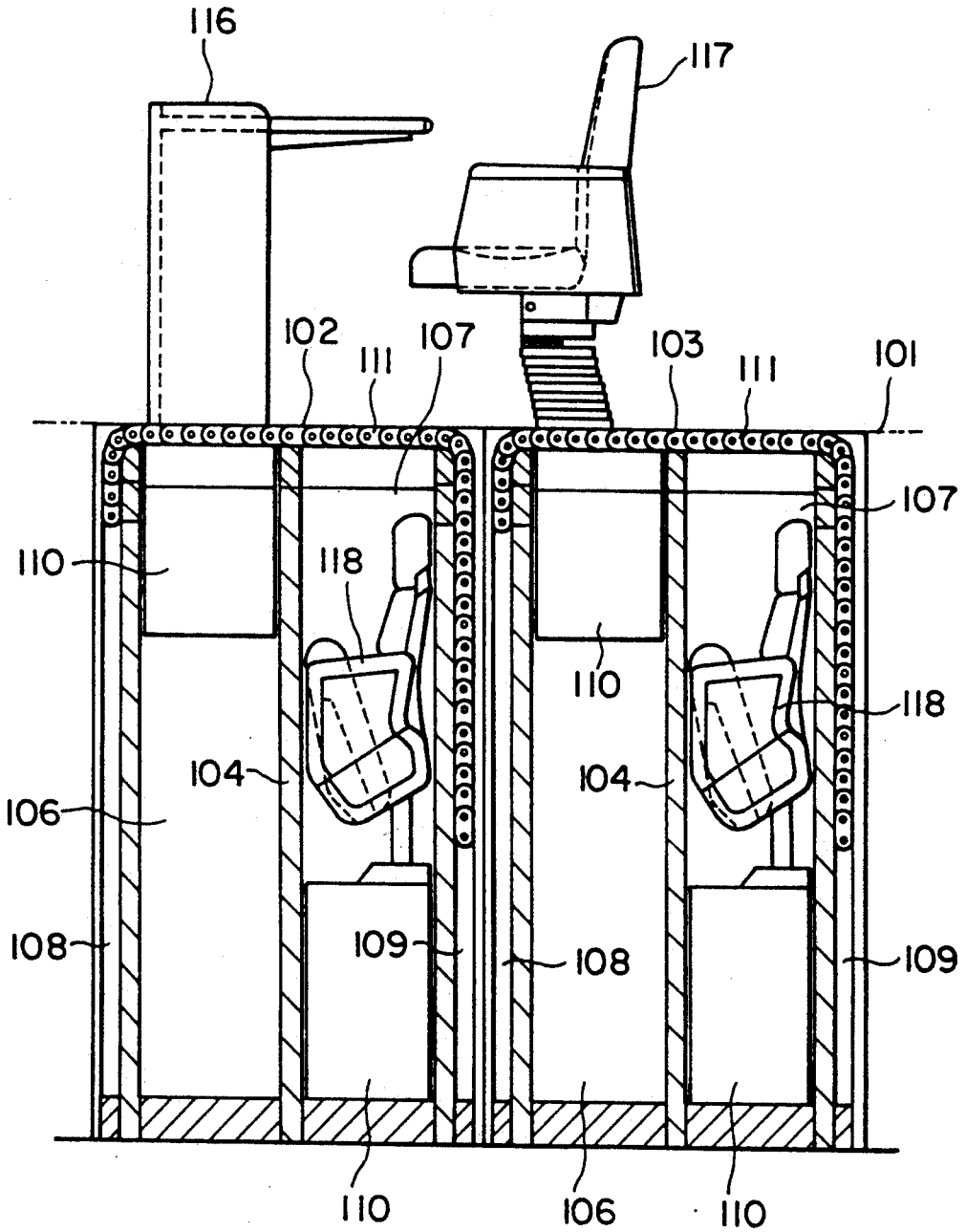
FIG. 12 is a vertical sectional side view of the apparatus, particularly illustrating that the tables and the chairs mounted on raising/lowering units are raised up above the floor surface of the building to assume an operative attitude.
Figure 14:
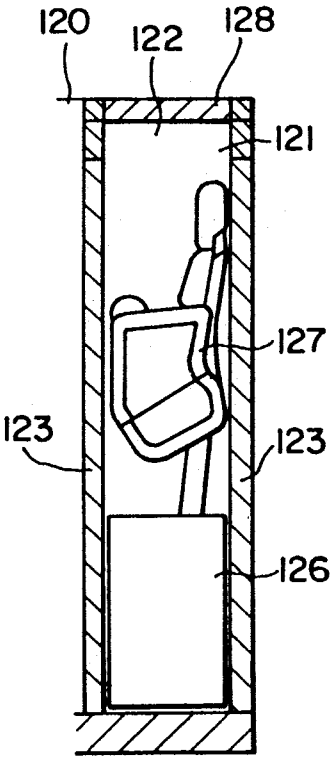
FIG. 14 is a vertical sectional side view of the apparatus shown in FIG. 13.

As is best seen in FIG. 10, the flexible cover plate 111 includes an opposing pair of chains 112, and a number of elongated plate pieces 113 are bridged between the pair of chains 112 to form a flexible central cover portion 114 while hollow spaces 115 are formed before and behind the flexible cover portion 114. A length of the flexible cover portion 114 as seen in the forward/rearward direction is dimensioned to fully cover the upper surface of each of the accommodating chambers 106 and 107, while a length of each hollow space 115 as seen in the forward/rearward direction is dimensioned to coincide with a width of each of both the opening portions 105 at the upper surfaces of the accommodating chambers 106 and 107.

Similarly, the second furniture accommodating section 103 includes a fore accommodating chamber 106 and a rear accommodating chamber 107 with a frame 104 likewise interposed therebetween, and the upper surfaces of the accommodating chambers 106 and 107 are exposed to the outside to form opening portions 105 in the same manner as the first furniture accommodating section 102. A raising/ lowering unit 110 is displaceably arranged in each of the accommodating chambers 106 and 107. A cover plate accommodating ga 108 is formed behind the fore accommodating chamber 106, while another cover accommodating gap 109 is formed behind the rear accommodating chamber 107. Both the fore and rear accommodating chambers 106 and 107 are arranged in the side-by-side relationship with a partition 104 interposed therebetween. A flexible cover plate 111 including a flexible cover portion 114 with hollow spaces 115 formed before and behind the flexible cover portion 114 is laid across the upper surfaces of the accommodating chambers 106 and 107, and a part of the flexible cover plate 111 is accommodated in each of the cover plate accommodating gaps 8 and 9.

A plurality of foldable tables 116 are mounted on the raising/lowering unit 110 in the fore accommodating chamber 106 of the first furniture accommodating section 102, while a plurality of foldable chairs 117 are mounted on the raising/lowering unit 110 in the fore accommodating chambers 106 of the second furniture accommodating section 103. The tables 116 and the chairs 107 are operatively associated with each other so that they are raised up and lowered together. In addition, a plurality of foldable chairs 118 are mounted on the raising/lowering unit 110 in the rear accommodating chamber 107 of each of the first and second furniture accommodating section 102 and 103. The chairs 118 are designed in a different manner from the chairs 117. Similarly, the chairs 118 in the rear accommodating chamber 107 of the first furniture accommodating section 102 and the chairs 118 in the rear accommodating chamber 107 of the second furniture accommodating section 103 are operatively associated with each other so that they are raised up and lowered together.

Figure 9:
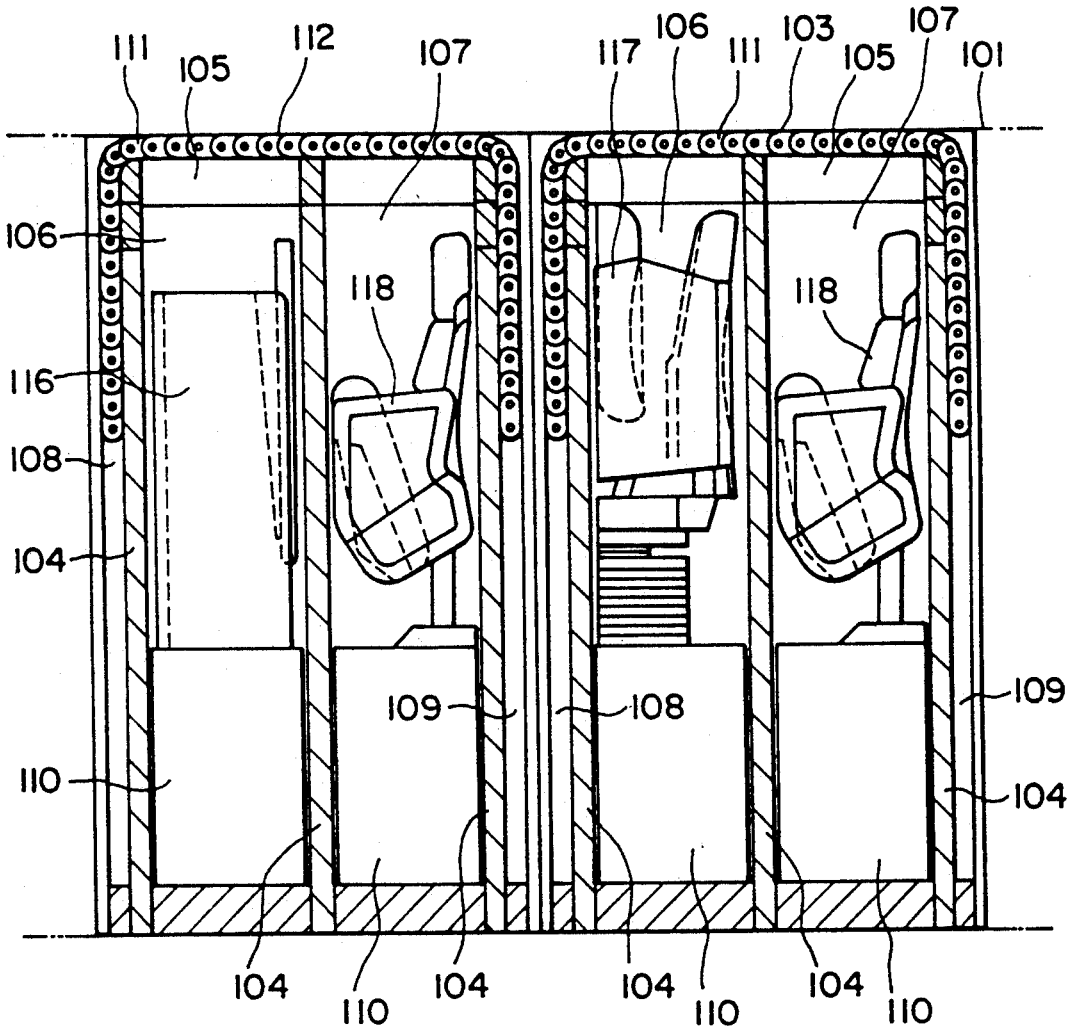
FIG. 9 is a vertical sectional side view of an apparatus for opening and closing a flexible cover plate for a furniture raising/lowering floor equipment in accordance with a second embodiment of the present invention, particularly illustrating that chairs and tables are accommodated in chair accommodating chambers and a table accommodating chamber to assume an inoperative attitude.

Since the apparatus is constructed in the above-described manner, when the tables 116 and the chairs 117 and 18 are not in use, they are flatly folded and accommodated in the accommodating chambers 106 and 107 in an inoperative state, as shown in FIG. 9. At this time, the upper surfaces of the accommodating chambers 106 and 107 in the first furniture accommodating section 102 are fully closed with the flexible cover portion 114 of the flexible cover plate 113. Similarly, the upper surfaces of the accommodating chambers 106 and 107 in the second furniture accommodating section 103 are fully closed with the flexible cover portion 114 of the flexible cover plate 111. As a result, a flat floor surface is formed by both the flexible cover portions 114 of the flexible cover plate 111.

When the chairs 118 are to be brought in an operative state from the foregoing folded inoperative state, the flexible cover plates 111 for both the furniture accommodating sections 102 and 103 are displaced in the forward direction until a half of each of the flexible cover portions 114 is accommodated in the cover plate accommodating gap 108, whereby only the fore accommodating chambers 106 are closed with the flexible cover portion 114 but the rear accommodating chambers 107 are kept still opened. Subsequently, as the raising/lowering units 110 in both the rear accommodating chambers 107 are raised up, the chairs 118 are caused to stand upright on the floor surface of the building through the opening portions 105 of both the rear accommodating chambers 107. Now, the chairs 118 are ready to be in use. On the contrary, when the chairs 118 are to be accommodated in an inoperative state, operations are performed in conformity with the reverse order to the aforementioned one.

On the other hand, when the tables 116 and the chairs 117 are to be in use, the flexible covers plate 111 for both the furniture accommodating sections 102 and 103 are displaced in the rearward direction until a half of each of the flexible cover portions 114 is accommodated in the cover plate accommodating gap 109, whereby only the rear accommodating chambers 107 are closed with the flexible cover portions 114 but the fore accommodating chambers 106 are kept still opened. As the raising/lowering units 110 in both the fore accommodating chambers 106 are raised up, the tables 116 are caused to stand upright on the floor surface of the building through the opening portion 105 and the chairs 117 are likewise caused to stand upright on the floor surface of the building through the opening portions 105. Now, the tables 116 and the chairs 117 are ready to be in use. On the contrary, when the tables 116 and the chairs 117 are to be accommodated in an inoperative state, operations are performed in conformity with the reverse order to the aforementioned one.

FIG. 13 to FIG. 17 illustrate an apparatus for opening and closing covering means for a furniture raising/lowering type floor equipment employable for a building such as a hall, a theater, gymnasium or the like in accordance with a third embodiment of the present invention wherein the covering means is prepared in the form of a flexible cover plate in the same manner as the second embodiment of the present invention.

According to the third embodiment of the present invention, the apparatus is arranged in a floor platform 120 of the building, and a chair accommodating chamber 121 is formed in the floor platform 120 while its upper surface is exposed to the outside to form an opening portion 122. In addition, cover plate accommodating gaps 124 and 125 defined by frames 123 are formed on the opposite sides of the chair accommodating chamber 121. A raising/lowering unit 126 adapted to be raised up and lowered by activating a driving unit (not shown) is displaceably arranged in the chair accommodating chamber 121, and an array of chairs 127 arranged in the side-by-side relationship as seen in the transverse direction are foldably mounted on the upper surface of the raising/lowering unit 126. A flexible cover plate 128 adapted to be displaced in the leftward/rightward direction is laid across the opening portion 122 of the chair accommodating chamber 121 between the cover plate accommodating gaps 124 and 125.

Figure 13:
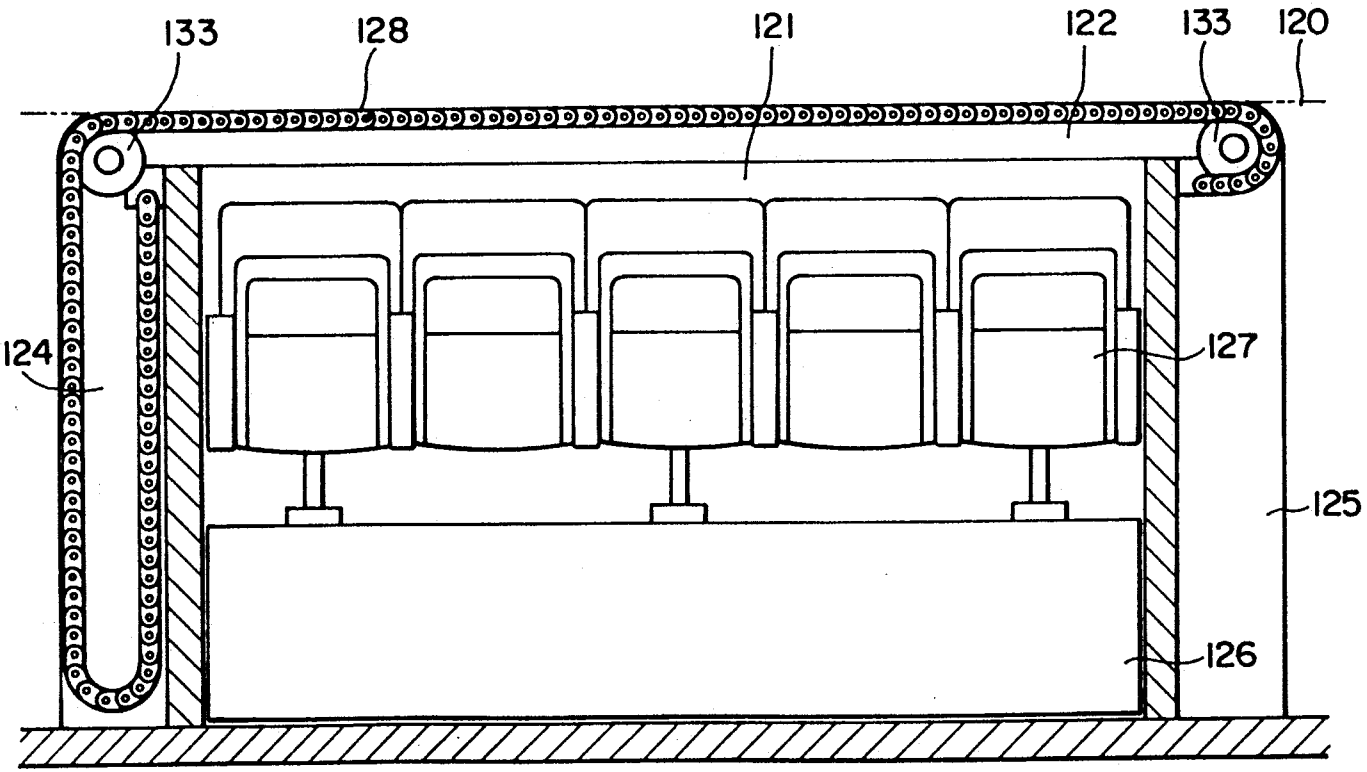
FIG. 13 is a vertical sectional front view of an apparatus for opening and closing a flexible cover plate for a chair raising/lowering equipment in accordance with a third embodiment of the present invention, particularly illustrating chairs are accommodating in a chair accommodating chamber to assume an inoperative attitude.
Figure 15:
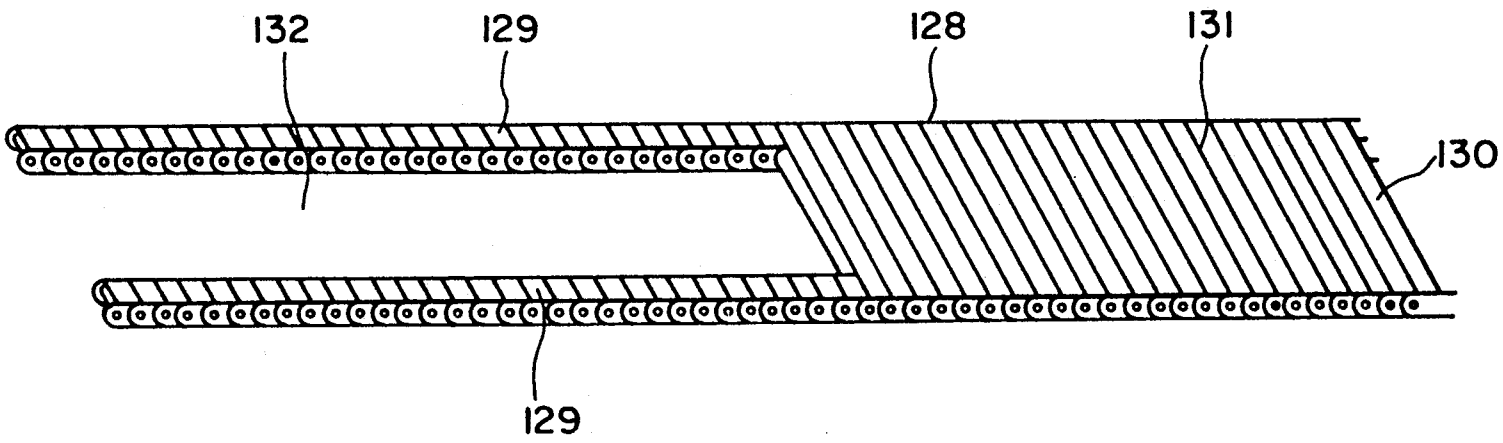
FIG. 15 is a perspective view of the flexible cover plate.
Figure 17:
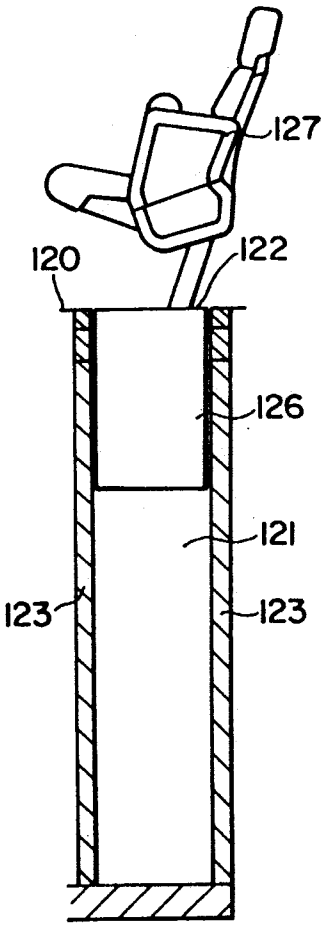
FIG. 17 is a vertical sectional side view of the apparatus shown in FIG. 16.

As shown in FIG. 15, the flexible cover plate 128 is constructed such that an opposing pair of chains 129 are arranged with a flexible cover portion 131 comprising a plurality of plate pieces 130 bridged therebetween and a single hollow space 132 is formed only leftward of the flexible cover portion 131 between the chains 129. A length of the flexible cover portion 131 and a length of the hollow space 132 are dimensioned to coincide with the full length of the chair accommodating chamber 121 on the upper surface of the floor platform 120. Thus, the full length of each chain 129 is dimensioned to be substantially twice as long as the width of the chair accommodating chamber 121 on the upper surface of the floor platform 120. The flexible cover plate 128 is laid over the chair accommodating chamber 121 to extend between the upper ends of the cover accommodating gaps 124 and 125 on the opposite sides of the chair accommodating chamber 121 while passing around sprockets 133 adapted to be rotated by a driving unit (not shown), as shown in FIG. 13. It should be added that the opposite ends of the chains 129 are fixedly secured to the upper ends of the frames 123 which define the cover plate accommodating gaps 124 and 125.

Since the apparatus is constructed in the above-described manner, when the chairs 127 are not in use, they are flatly folded and accommodated in the chair accommodating chamber 121 in an inoperative state, and the opening portion 122 of the chair accommodating chamber 121 is closed with the flexible cover portion 131 of the cover plate 128 to form a flat floor surface flush with the floor surface of the building.

Figure 16:
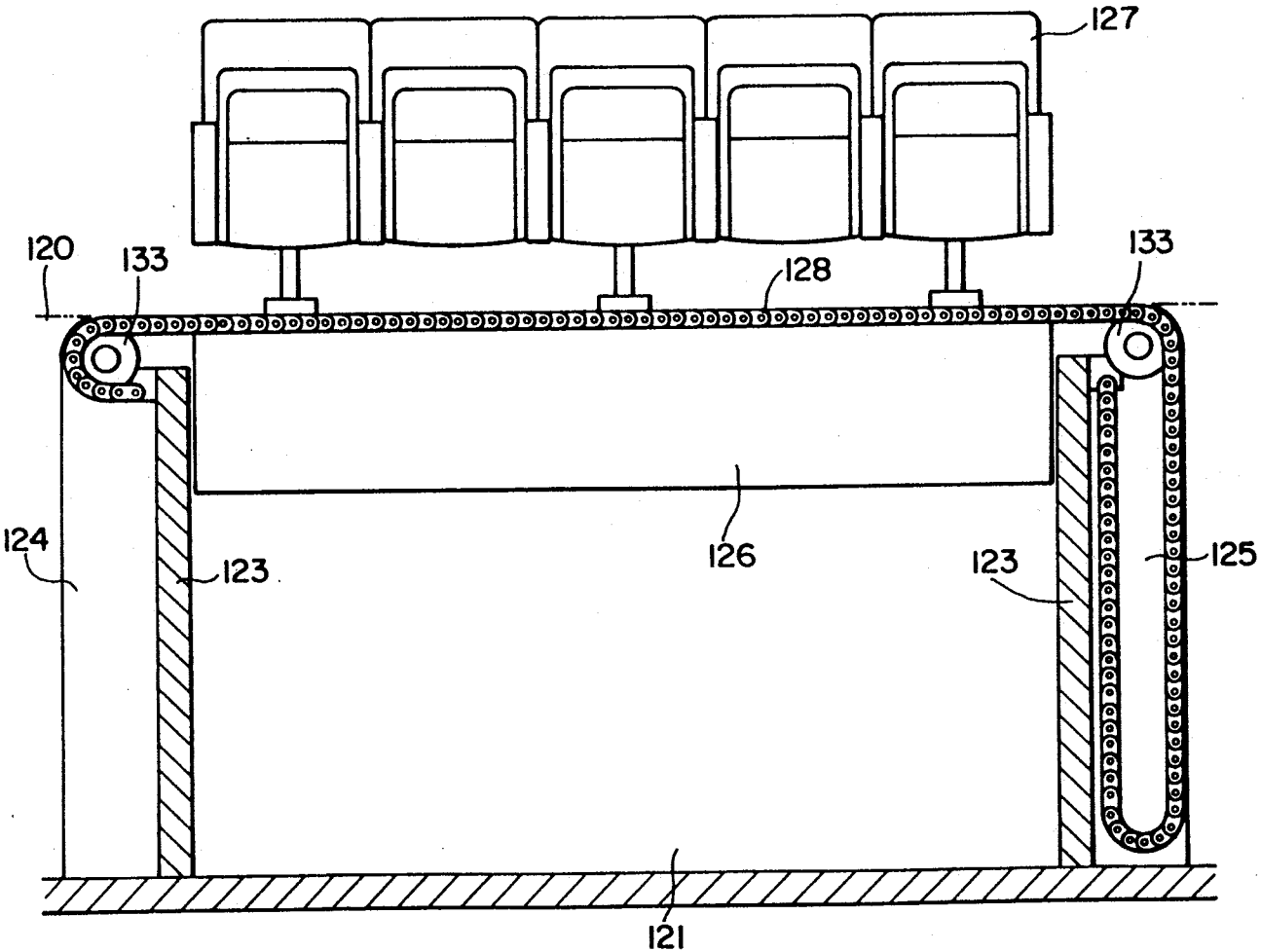
FIG. 16 is a vertical sectional front view of the apparatus, particularly illustrating that the chairs mounted on a raising/lowering unit are raised up above the floor surface of the building to assume an operative attitude.

When the chairs 127 are to be brought in practical use, the sprockets 133 are rotated by the driving unit so that the chains 129 meshing with the sprockets 133 are displaced in the rightward direction so as to allow about a half of the chains 129 corresponding to the flexible cover portion 131 to be accommodated in the cover plate accommodating gap 125, as shown in FIG. 16. At this time, the hollow space 132 of the cover plate 128 is located in alignment with the opening portion 122 of the chair accommodating chamber 121. When the raising/lowering unit 126 is raised up to the upper end of the chair accommodating chamber 121, the chairs 127 are caused to stand upright above the floor surface of the building through the opening portion 122 of the chair accommodating chamber 121. Now, the chairs 127 are ready to be in use. On the contrary, when the chairs 127 are to be accommodated in the chair accommodating chamber 121 to assume an inoperative attitude, operations are performed in conformity with the reverse order to the aforementioned one.

While the present invention has been described above with respect to three preferred embodiments thereof, it should of course be understood that the present invention should not be limited only to these embodiments but various changes or modifications may be made without any departure from the scope of the invention as defined by the appended claims.

What is claimed is:

1. An apparatus for opening and closing covering means for a furniture raising/lowering type floor equipment employable for a building such as a hall, a theater, a gymnasium or the like wherein said covering means is prepared in the form of a rigid cover plate, comprising;

a furniture accommodating chamber in which a plurality of furnitures are accommodated in a folded state to assume an inoperative attitude when they are not in use, a raising/lowering unit vertically displaceably arranged in said furniture accommodating chamber with said furnitures mounted thereon, said raising/lowering unit being raised up by activating a driving unit so as to allow said furnitures to be unfolded and then stand upright above the floor surface of said building to assume an operative attitude, a cover plate accommodating gap formed adjacent to said furniture accommodating chamber with frames and guide rails located therebetween, an opposing pair of links each having cutouts formed at the opposite ends thereof such that each of said links turns about a first shaft projecting from said frame while a second shaft projecting from said raising/lowering unit is received in the inner cutout of said link and a third shaft projecting from a slide link is received in the outer cutout of the same, and an opposing pair of slide links pivotally connected to one end of said cover plate and slidably arranged in said cover plate accommodating gap, whereby as said raising/lowering unit is raised up, said links turn about said first shafts with the aid of said second shafts in the inner cutouts of said links to slidably displace said slide links in the downward direction via said third shafts in the outer cutouts of the same thereby to turnably pull down said cover plate in said cover plate accommodating gap until said cover plate is fully accommodated in said cover plate accommodating gap.

2. The apparatus as claimed in claim 1, wherein rollers are arranged on each guide rail to facilitate slidable displacement of said cover plate, one of said rollers being located at the upper end of said guide rail.

* * * * *

UNITED STATES PATENT AND TRADEMARK OFFICE

CERTIFICATE OF CORRECTION

PATENT NO. : 5,245,799
DATED : September 21, 1993
INVENTOR(S) : Noboru Sugiyama

It is certified that error appears in the above-indentified patent and that said Letters Patent is hereby corrected as shown below:

Title page, item [30], should read as follows:

Foreign Application Priority Data,
Nov. 30, 1990 [JP] Japan 2-333537 [P]
Dec. 27, 1990 [JP] Japan 2-406909 [U]

Signed and Sealed this

Thirteenth Day of December, 1994

*Attest:*

Bruce Lehman

BRUCE LEHMAN

*Attesting Officer*

*Commissioner of Patents and Trademarks*